US010423105B2

(12) United States Patent
Ishikura et al.

(10) Patent No.: US 10,423,105 B2
(45) Date of Patent: Sep. 24, 2019

(54) HEAT FIXING BELT, METHOD FOR PRODUCING HEAT FIXING BELT, AND IMAGE FIXING DEVICE

(71) Applicant: KINYOSHA CO., LTD., Tokyo (JP)

(72) Inventors: Sadayuki Ishikura, Tokyo (JP); Yohei Chabata, Tokyo (JP)

(73) Assignee: KINYOSHA CO., LTD., Tokyo (JP)

( * ) Notice: Subject to any disclaimer, the term of this patent is extended or adjusted under 35 U.S.C. 154(b) by 0 days.

(21) Appl. No.: 16/138,473

(22) Filed: Sep. 21, 2018

(65) Prior Publication Data

US 2019/0033761 A1 Jan. 31, 2019

Related U.S. Application Data

(63) Continuation of application No. PCT/JP2017/005911, filed on Feb. 17, 2017.

(30) Foreign Application Priority Data

Mar. 22, 2016 (JP) ..... 2016-057476

(51) Int. Cl.
*G03G 15/20* (2006.01)

(52) U.S. Cl.
CPC ..... *G03G 15/2053* (2013.01); *G03G 15/20* (2013.01); *G03G 15/2064* (2013.01); *G03G 2215/2016* (2013.01)

(58) Field of Classification Search
None
See application file for complete search history.

(56) References Cited

U.S. PATENT DOCUMENTS

2011/0293340 A1* 12/2011 Yamamoto ..... G03G 15/2053 399/329
2011/0299902 A1 12/2011 Yonekawa et al.
2014/0079454 A1* 3/2014 Mukoyama ..... H05B 3/0095 399/329

FOREIGN PATENT DOCUMENTS

JP H075784 1/1995
JP 2000058228 2/2000
JP 2003223969 8/2003
(Continued)

OTHER PUBLICATIONS

International Search Report for International Application PCT/JP2017/005911, dated Apr. 18, 2017.
(Continued)

*Primary Examiner* — Clayton E. LaBalle
*Assistant Examiner* — Jas A Sanghera
(74) *Attorney, Agent, or Firm* — Burris Law, PLLC

(57) ABSTRACT

This heat fixing belt is provided with a tubular belt base that is formed from an insulating heat-resistant resin, an elastic resistive heat generation layer that is formed from an elastic base material containing an elastic material and contains conductive material, a toner release layer, and a pair of electrode layers for feeding a power to the elastic resistive heat generation layer. The elastic resistive heat generation layer is provided on the outer circumferential surface of the belt base. The toner release layer is provided as the outermost layer. The pair of electrode layers are provided on both end portions of the outer circumferential surface of the elastic resistive heat generation layer, and have a volume resistivity that is lower than the volume resistivity of the elastic resistive heat generation layer.

11 Claims, 4 Drawing Sheets

(56) References Cited

FOREIGN PATENT DOCUMENTS

| | | |
|---|---|---|
| JP | 2004281123 | 10/2004 |
| JP | 2007272223 | 10/2007 |
| JP | 2009092785 | 4/2009 |
| JP | 2011170211 | 9/2011 |
| JP | 2011253083 | 12/2011 |
| JP | 2012118318 | 6/2012 |
| JP | 2013122531 | 6/2013 |
| JP | 2015094886 | 5/2015 |

OTHER PUBLICATIONS

Office Action dated Jul. 25, 2019, for Korean application No. 1020187029007.

* cited by examiner

HEAT FIXING BELT, METHOD FOR PRODUCING HEAT FIXING BELT, AND IMAGE FIXING DEVICE

CROSS-REFERENCE TO RELATED APPLICATIONS

This application is a continuation of International Application No. PCT/JP2017/005911, filed on Feb. 17, 2017, which claims priority to and the benefit of JP 2016-057476 filed on Mar. 22, 2016. The disclosures of the above applications are incorporated herein by reference.

FIELD

The present disclosure relates to a heat fixing belt for thermally fixing a toner image on an image support, a method for producing the heat fixing belt, and an image fixing device in an image forming apparatus such as a copier and a printer.

BACKGROUND

The statements in this section merely provide background information related to the present disclosure and may not constitute prior art.

Recently, it has been proposed to use an image forming apparatus including a heat fixing belt with a resistive heat generation layer in an image forming apparatus such as a copier and a printer for forming a toner image by thermally fixing unfixed toner placed on an image support such as plain paper. When power is fed to the resistive heat generation layer, the fixing belt generates heat to thereby achieve toner heat fixing. An image forming apparatus adopting this fixing method excels in shortening its warm-up time, saving its energy and increasing its speed as compared with a conventional method.

On one hand, one method of increasing the amount of heat generated from the heat fixing belt is to decrease the volume resistance value of the resistive heat generation layer. For example, as a technology for the method, it is proposed to disperse conductive materials such as carbon-based conductive agents and metallic particles in materials of a binder (JP 2007-272223 A). This technology requires that the conductive materials be dispersed uniformly to attain a uniform heating generation temperature. JP 2007-272223 A discloses a technology of using carbon nanomaterials and filamentary metallic particles as the conductive materials. However, it is difficult to increase the mixture amount of carbon nanomaterials in terms of price.

JP 2000-058228 A discloses a thin-film resistance heating element using a carbon nanotube and a carbon micro-coil as conductive materials and a toner heating fixing member using the thin-film resistance heating element. However, the thin-film resistance heating element that is formed of a carbon nanotube and a carbon micro-coil decreases in its mechanical strength. It is thus difficult to decrease the volume resistance value by increasing the mixture amount of carbon nanotube and the like.

On the other hand, when an electrode layer to feed power to the resistive heat generation layer is provided on the surface of the resistive heat generation layer, it is difficult to cause the resistive heat generation layer and the electrode layer to adhere firmly to each other, and its long-period use causes the problem that an electrode is peeling off, and the like. JP 2013-122531 A discloses a method of forming an electrode by an electroless plating process in which metallic nanoparticles supplied onto the surface of a resistive heat generation layer are used as a catalyst. However, even with this method, sufficient adhesion has not been achieved.

SUMMARY

An object of the present invention aims to provide a heat fixing belt that excels in bending resistance and durability. For example, it is an object of the present invention to provide a heat fixing belt capable of decreasing a volume resistance value by increasing the amount of conductive materials and in this case, too, achieving high bending resistance and high durability.

The heat fixing belt for solving above problems is provided with: a tubular belt base that is formed from an insulating heat-resistant resin; an elastic resistive heat generation layer that is formed from an elastic base material containing an elastic material and contains conductive material; a toner release layer; and a pair of electrode layers for feeding a power to the elastic resistive heat generation layer. The elastic resistive heat generation layer is provided on the outer circumferential surface of the belt base. The toner release layer is provided as the outermost layer. The pair of electrode layers are provided on both end portions of the outer circumferential surface of the elastic resistive heat generation layer, and have a volume resistivity that is lower than the volume resistivity of the elastic resistive heat generation layer.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1A:
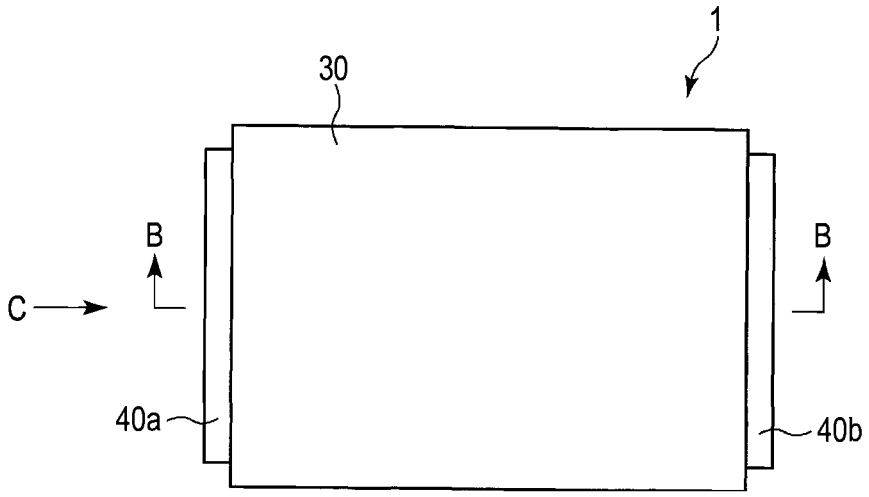
FIG. 1A shows the front of the heat fixing belt.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

An embodiment provides a heat fixing belt for thermally fixing a toner image on an image support in an image fixing device used in an image forming apparatus such as a copier and a printer. The embodiment of the present invention will be described in detail below with reference to the accompanying drawings.

Figure 1B:
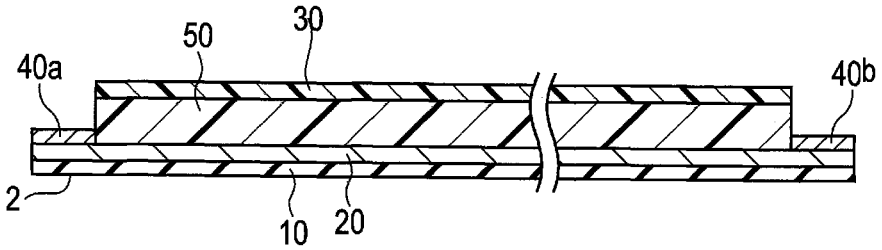
FIG. 1B shows an enlarged section thereof cut along line B-B of FIG. 1A.
Figure 1C:
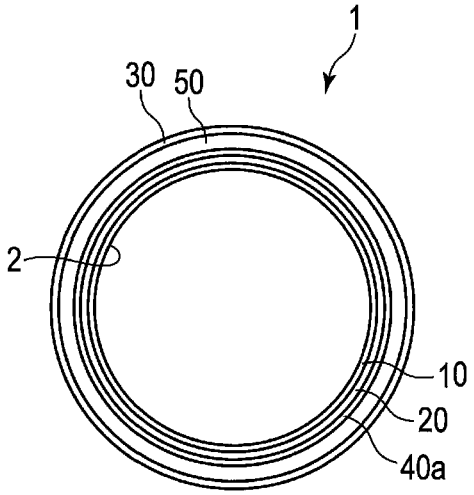
FIG. 1C shows the side thereof viewed from side C of FIG. 1A.

FIGS. 1A, 1B, and 1C are diagrams showing one example of a heat fixing belt according to the embodiment. FIG. 1A shows the front of the heat fixing belt, FIG. 1B shows an enlarged section thereof cut along line B-B of FIG. 1A, and FIG. 1C shows the side thereof viewed from side C of FIG. 1A.

The heat fixing belt 1 includes a tubular belt base 10, an elastic resistive heat generation layer 20 existing on the circumferential surface of the base 10, a toner release layer 30 as the outermost layer existing on the circumferential surface of the heat fixing belt 1, a pair of electrode layers 40*a* and 40*b* arranged to feed power to the elastic resistive heat generation layer 20, and an elastic layer 50 existing between the elastic resistive heat generation layer 20 and the toner release layer 30 and in contact with these layers.

The belt base 10 is a member that is a base of the heat fixing belt 1 and the layers are laminated on the circumferential surface thereof. The belt base 10 is shaped like a tube and set in an image fixing device of an image forming apparatus such as a copier and a printer, with a core member in the interior thereof when it is used, the details of which will be described later.

The belt base 10 is made of heat-resistant resin and favorably it is insulative. The belt base 10 may contain polyphenylene sulfide (PPS), polyimide (PI), polyamide-imide (PAI), polyether ether ketone (PEEK), etc., alone or in combination, as resin materials. Alternatively, it can be made of a mixture including some of these materials in combination or heat-resistant resin including these resins as the chief material, but it is not limited to these materials.

According to one preferred embodiment, it is characterized that as a favorable heat-resistant resin of which the belt base 10 is made, resin selected from the group of polyphenylene sulfide, polyimide, polyamide-imide and polyether ether ketone or a combination thereof is used as the chief material.

The belt base 10 has only to be a tubular one, the ratio of the inner diameter thereof to the width thereof is not particularly restricted, it may be, for example, between 1:1-20 and can be, for example, 1:5-10. The thickness of the belt base 10 is, for example, 0.02 mm to 0.2 mm and can be, for example, 0.05 mm to 0.1 mm, the thickness is not limited to these values.

The toner release layer 30 is provided on the circumferential surface of the belt base 10 and on the outermost layer of the heat fixing belt 1. The toner release layer 30 is provided as an upper layer of the tubular belt base 10 and the elastic resistive heat generation layer 20 and as the outermost layer on the periphery of the heat fixing belt 1. The toner release layer 30 is brought into direct contact with toner and a support such as paper and sheet on which the toner is placed. In contact with them, heat is applied to them to fix the toner and form a toner image. Thus, a region where the toner release layer 30 is disposed may be reached that where formed seamlessly on the entire circumferential surface of the heat fixing belt 1 in the rotation direction (or formed circularly), and in the width direction of the heat fixing belt 1, that is, in the axial direction of that, the same range as a region where the support can be present or a broader range, or in the same range as a region where a toner image to be fixed can be present or a broader range. FIGS. 1A, 1B, and 1C show an example in which the toner release layer 30 is formed on the entire circumferential surface of the belt base 10 excluding portions close to both ends of the belt base 10.

The toner release layer 30 can be formed of a material that is excellent in heat resistance and releasable from the toner and the support. The toner release layer 30 can be formed of, e.g., fluorocarbon resin. Examples of the fluorocarbon resin include polytetrafluoroethylene (PTFE), tetrafluoroethylene perfluoroalkyl vinyl ether copolymer (PFA), tetrafluoroethylene-hexafluoroethylene copolymer (FEP), and the like, or can be formed of a mixture of these materials.

It is favorable that the thickness of the toner release layer 30 is 5 to 30 μm. To stabilize adherability, the toner release layer may be molded after primer is applied thereto. The primer may itself be any well-known material.

In one embodiment, it is characterized that the toner release layer is formed of fluorocarbon resin, in the heat fixing belt 1.

The heat applied to a target to be fixed through the toner release layer 30 is generated by energizing the elastic resistive heat generation layer 20.

The elastic resistive heat generation layer 20 is disposed on the outer circumferential surface of the belt base 10. The elastic resistive heat generation layer 20 is formed of an elastic base material including an elastic material and the elastic base material further includes a conductive material.

Though the elastic material is not particularly restrictive, it is favorable that it is the elastic material with heat resistance from the view point of the fixing temperature of toner. As examples of the elastic material, there are silicone rubber, fluorocarbon rubber, fluorosilicone rubber, hydrogenated nitrile rubber and the like. Of these rubbers, for example, the fluorocarbon rubber is particularly excellent in heat resistance and thus favorable.

The elastic base material can include, for example, these elastic materials alone or in combination with another heat-resistant material. The material of the elastic base material can be, for example, fluorocarbon rubber alone or a mixture of an elastic material such as fluorocarbon rubber and another heat-resistant material. For example, when fluorocarbon rubber is used mixed with another heat-resistant material, if the total of the fluorocarbon rubber and another heat-resistant material is 100% by weight, it is favorable that fluorocarbon rubber is 80% by weight or more. As further examples of the heat-resistant material that can be mixed with the elastic material, there are polyphenylene sulfide (PPS), polyimide (PI), polyamide-imide (PAI), polyether ether ketone (PEEK), fluorocarbon resin, and the like.

According to one embodiment, it can be characterized that the elastic material is fluorocarbon rubber, silicone rubber, fluorosilicone rubber, hydrogenated nitrile rubber, or a combination thereof.

The conductive material contained in the elastic resistive heat generation layer 20 is not particularly restricted but may include a carbon-based conductive material such as a carbon black, graphite, a carbon nanotube and a carbon nanofiber, and a variety of metallic particles. These conductive materials can be used alone or as a mixture of different types. For example, KETJENBLACK (Lion Specialty Chemicals, Co., Ltd.) can favorably be used in terms of the volume resistance value required by the resistive heat generation layer and the price of the conductive materials.

In one embodiment, the conductive material can be a carbon-based conductive material or metallic particles.

In one embodiment, when a conductive material is mixed into an elastic material as the material for the elastic base material, the mixture amount of the conductive material may be 10 to 50% by weight based on 100% by weight of the elastic material. If the mixture amount of the conductive material is 10% by weight or less, the uniformity of the volume resistance value cannot be obtained, and if it is 50% by weight or more, the bending resistance of the resistive heat generation layer lowers.

The material for the elastic base material may include a desired amount of additives, such as a crosslinking agent, a filler, a dispersant and a combination thereof, when necessary.

The elastic resistive heat generation layer 20 can be arranged on the entire outer circumferential surface of the belt base 10 (that is, arranged circularly). The thickness of the elastic resistive heat generation layer can be set to, e.g., 20 to 500 μm. With this thickness, a desired performance can be achieved. When it is 20 μm or less, the mechanical strength of the resistive heat generation layer is insufficient, when it is 500 μm or more, the bending resistance of the elastic resistive heat generation layer lowers. More favorably, the thickness of the resistive heat generation layer can be 50 to 300 μm. In the heat fixing belt 1 according to the embodiment, the elastic resistive heat generation layer contains an elastic material. It is thus possible to increase the conductive material to lower the volume resistance value, and even though the conductive material is increased, the heat fixing belt 1 excels in bending resistance and has high durability when it is used. It is also possible to thicken the thickness of the resistive heat generation layer to increase the amount of heat generation.

As method for mix a conductive material in an elastic material, a kneading method using an open roll can be used. For example, a larger amount of conductive materials than usual can be mixed in the elastic resistive heat generation layer 20 to lower the volume resistance value of the elastic resistive heat generation layer 20. If a large amount of materials are so mixed, it may be difficult to perform a kneading operation because the hardness of a compound increases. In this case, for example, dispersion in which conductive materials are dispersed uniformly in the solvent can be used. In such the dispersion, for example, a liquid elastic base material can be used. The liquid elastic base material is, for example, a liquid material in which elastic materials and the like are dissolved or dispersed in a desired solvent. The use of such the liquid material makes it possible to include a larger amount of conductive materials than usual in the elastic base material. The elastic base material so obtained using the liquid material is excellent in the dispersion uniformity of conductive materials, and uniform conductivity is achieved in the elastic resistive heat generation layer 20. As the solvent used in the liquid material, for example, an organic solvent such as MEK and MIBK and water are possible.

In the formation the elastic resistive heat generation layer 20 on the outer circumferential surface of the tubular belt base 10, when, e.g., a solid-state material is used, it is wound on the outer circumferential surface of the tubular belt base 10 and then cured, and the surface is ground. When a liquid material is used, it has only to be applied onto the outer circumferential surface of the tubular belt base 10 using a well-known method such as spray coating and dipping and then cured. However, the method of forming the elastic resistive heat generation layer 20 is not limited to these methods.

In one embodiment, it can be characterized that the elastic resistive heat generation layer 20 containing a conductive material and formed of an elastic base material including an elastic material is formed using a liquid material that is dissolved or dispersed in the solvent.

According to one embodiment, it can be characterized that the elastic resistive heat generation layer 20 exhibits bending resistance to prevent a crack and peeling from occurring when it is folded using a cylindrical mandrel with a diameter of 5 mm in conformity with JIS K 5600-5-1: 1999.

The elastic resistive heat generation layer 20 can be formed on the entire circumferential surface of the belt base 10. Alternatively, it can be formed on the circumferential surface of the belt base 10 and seamlessly on the entire circumferential surface of the heat fixing belt 1 in the rotation direction. In the width direction of the heat fixing belt 1, namely in the axial direction thereof, the layer 20 can be formed in the same range as a region where the support of the belt base 10 can be present or a broader range, or in the same range as a region where a toner image to be fixed can be present or a broader range, namely a range corresponding to a region where the toner release layer 30 is present. Favorably, the layer 20 is formed in a range that is broader than the region where the toner release layer 30 is present and more favorably, it is formed on the entire circumferential surface of the belt base 10. In the example shown in FIGS. 1A, 1B, and 1C, the elastic resistive heat generation layer 20 is formed on the entire circumferential surface of the belt base 10. The energization of the elastic resistive heat generation layer 20 is performed by the energization of the electrode layer 40 (40*a*, 40*b*) as described below.

The electrode layer 40 is formed on the belt base 10 such that power can be fed to the elastic resistive heat generation layer 20, and at least part thereof is exposed on the heat fixing belt 1 such that it can be brought into contact with a feeding section to transfer electricity from the power supply to the electrode layer 40.

In the example shown in FIGS. 1A, 1B, and 1C, the electrode layer 40 is formed on the top surface of the elastic resistive heat generation layer 20 formed on the entire circumferential surface of the belt base 10 and in a region where the toner release layer 30 is not present, namely, seamlessly on the entire circumferential surface of the heat fixing belt 1 in the rotation direction, in close to both ends of the belt base 10. Specifically, in this example, the electrode layer 40*a* is formed on the top surface of the elastic resistive heat generation layer 20 close to one end thereof without overlapping the toner release layer 30, and the electrode layer 40*b* is formed on the top surface of the elastic resistive heat generation layer 20 close to the other end thereof without overlapping the toner release layer 30. With this formation, power can easily be fed continuously to the elastic resistive heat generation layer 20.

The electrode layer 40 is formed of a material whose volume resistance value is lower than that of the elastic resistive heat generation layer 20. For example, the electrode layer 40 can be formed of an electrode layer material such as conductive paste and conductive ink in which metallic particles of Cu, Ni, Ag, Al, Au and Mg, a mixture of some of these elements, etc., are dispersed in a binder. For example, when the electrode layer 40 is formed of only a general conductive paste and a general conductive ink, it can be made very hard. This case causes, e.g., a problem that a crack occurs because the it does not follow the deformation at the time of use. Therefore, the electrode layer material can further include an elastic material in binder components. If an elastic material is included in the electrode layer material and then forms the electrode layer 40, it is possible to obtain the electrode layer that is excellent in bending resistance. Furthermore, the electrode layer material may include a proper amount of additives, such as a crosslinking agent, a filler, a dispersant and a combination thereof, when necessary.

The binder included in the electrode layer material can be any binder that can be used in the electrode layer material such as a general conductive paste and a general conductive ink, or can be a combination of these materials. As the elastic material included in the electrode material, the elastic material to be included in the foregoing elastic resistive heat generation layer 20 can be used. It is particularly favorable to select and use an elastic material of the same type as the elastic material included in the foregoing elastic resistive heat generation layer 20. Accordingly, the elastic material and electrode layer material for the elastic resistive heat generation layer 20 can be co-vulcanized to achieve strong adhesion. Such a configuration obviates the necessity to interpose an adhesive between the elastic resistive heat generation layer 20 and the electrode layer 40. Thus, when power is fed to the electrode layer 40, there is no influence of the volume resistance value of an adhesive layer. For example, in the heat fixing belt 1 according to one embodiment, it is favorable that the elastic material of the elastic resistive heat generation layer 20 is fluorocarbon rubber and the electrode layer material includes fluorocarbon rubber of the same type. It is thus possible to obtain the electrode layer 40 that is excellent in bending resistance and adhesion.

In one embodiment, the binder included in the electrode layer material includes an elastic material of the same type as that of the elastic material included in the elastic resistive heat generation layer 20, and it is favorable that as the mixture ratio of the elastic material, the elastic material is not less than 10% by weight out of 100% by weight of binder components. If the elastic material included in the binder components is 10% by weight or less, it cannot adhere to the elastic resistive heat generation layer 20 sufficiently.

In one embodiment, the electrode layer material is formed of a material obtained by mixing metallic particles into the binder components containing at least an elastic material of the same type as that of the elastic resistive heat generation layer 20 and may be the heat fixing belt 1 in which the electrode layer 40 and the elastic resistive heat generation layer 20 are laminated without using an adhesive between them. The heat fixing belt 1 can be formed by heating and curing the elastic resistive heat generation layer 20 and the electrode layer 40 at the same time.

The formation of the electrode layer 40 is not particularly restrictive; however, a well-known coating method such as spray coating and a bar coater can be used.

The thickness of the electrode layer 40 can be 1 μm or more and 50 μm or less. Depending on the volume resistance value of the electrode layer 40, if the thickness is, for example, 1 μm or less, it is difficult to supply current instantaneously over the entire circumferential surface of the elastic resistive heat generation layer 20. If the thickness is 50 μm or more, the electrode layer 40 is likely to be very hard and does not follow the deformation at the time of use, with the result that a crack and peeling are likely to occur. The width of the electrode layer 40 has only to be a value capable of feeding power and is not particularly restrictive.

In one embodiment, it is characterized that the thickness of the electrode layer 40 is 1 μm or more and 50 μm or less.

In one embodiment, the heat fixing belt 1 has the following feature. The paired electrode layers 40*a* and 40*b* are formed of metallic particles that are included in a binder. The binder component is an elastic base material of the same type as that of the elastic base material of the elastic resistive heat generation layer 20. The paired electrode layers 40*a* and 40*b* and the elastic resistive heat generation layer 20 are directly coupled without using an adhesive between them.

In the heat fixing belt 1 according to one embodiment, it can be characterized that the elastic resistive heat generation layer 20 includes fluorocarbon rubber and the electrode layer material of the electrode layer 40 includes fluorocarbon rubber of the same type.

The volume resistance value of the elastic resistive heat generation layer 20 may be $1.0\times10^{-3}$ Ω·cm or higher and $1.0\times10^{3}$ Ω·cm or lower. For example, when it is $1.0\times10^{3}$ Ω·cm or higher, a variation in the volume resistance value tends to vary greatly, and if the variation is very large, a uniform heating temperature is difficult to obtain. For example, when it is $1.0\times10^{-3}$ Ω·cm or less, there is a trend to require a large amount of conductive materials, thereby the elastic resistive heat generation layer 20 increases in its thickness and thus the bending resistance may be lowered gradually.

According to one embodiment, it is favorable that the paired electrode layers 40*a* and 40*b* each have a volume resistance value of $1.0\times10^{-3}$ Ω·cm or less.

The volume resistance value of the electrode layer 40 is lower than that of the elastic resistive heat generation layer 20 and is $1.0\times10^{-3}$ Ω·cm or less. For example, the higher the volume resistance value of the electrode layer 40 than that of the elastic resistive heat generation layer 20 or the higher the volume resistance value of the electrode layer 40 than $1.0\times10^{-3}$ Ω·cm, the more difficult the supply of sufficient current to the elastic resistive heat generation layer 20 from the electrode layer 40.

According to one embodiment, an elastic layer 50 can be presented between and in contact with the elastic resistive heat generation layer 20 and the toner release layer 30. The elastic layer 50 can be formed to fix toner satisfactorily even though it is a support having irregularities on its surface. The elastic layer is thus formed within the same range as that of the toner release layer 30. For example, in the heat fixing belt 1 shown in FIGS. 1A, 1B, and 1C, the elastic layer 50 is formed on the elastic resistive heat generation layer 20 and the toner release layer 30 is formed on the elastic layer 50. The elastic layer 50 is disposed within a range on the elastic resistive heat generation layer 20 which corresponds to the toner release layer 30 (disposed within the same range as that of the toner release layer 30).

For the elastic layer 50, an elastic layer material with heat resistance and low rubber hardness can be used. As examples of the elastic layer material, there are fluorocarbon rubber, silicone rubber, and a combination thereof, for example, silicone rubber with hardness of 10 to 40 degrees by JIS A can favorably be used. The thickness of the elastic layer 50 can be, for example, 100 to 300 μm. To improve the adhesion between the elastic resistive heat generation layer 20 and the elastic layer 50, a well-known primer can be applied between them by, e.g., coating.

According to one preferred embodiment, the elastic layer 50 is formed of fluorocarbon rubber or silicone rubber. According to a further preferred embodiment, the elastic layer 50 has a thickness of 100 μm or more and 300 μm or less.

According to these embodiments, there is provided a heat fixing belt that excels in bending resistance and durability when it is used. This heat fixing belt excels in bending resistance and durability when it is used even though the amount of conductive materials is increased to lower the volume resistance value.

According to one embodiment, the heat fixing belt is manufactured by the following manufacturing method. First, paint for the heat-resistance elastic material and the elastic base material containing curing agent is prepared. Then, dispersion of conductive materials is prepared. The paint and the dispersion are mixed together to obtain an elastic resistive heat generation layer material. The elastic resistive heat generation layer material is applied onto the outer circumferential surface of a tubular belt base that is formed of an insulative heat-resistant resin and then dried to form an elastic resistive heat generation layer that has not yet been cured. After that, an electrode material is applied to each side end portion of the outer circumferential surface of the elastic resistive heat generation layer that has not yet been cured, dried and thermally cured to form a pair of electrode layers and an elastic resistive heat generation layer containing conductive materials and elastic materials on the belt base. The pair of electrode layers have a volume resistance value that is lower than that of the elastic resistive heat generation layer and is intended to feed power to the elastic resistive heat generation layer. Then, a toner release layer is formed on the outermost layer.

Figure 2A:
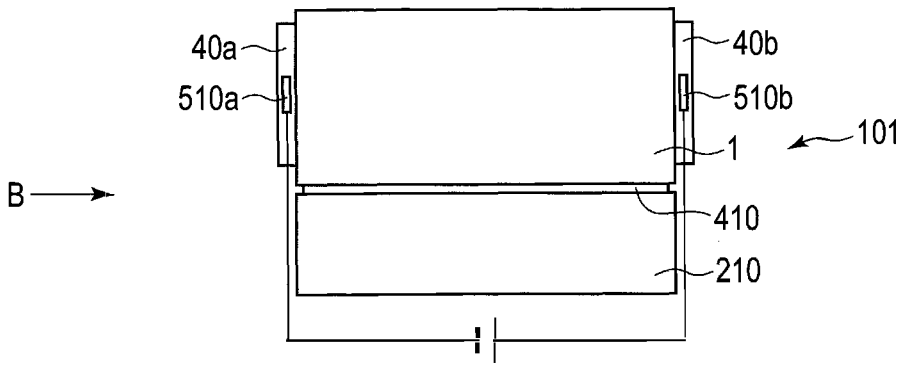
FIG. 2A is a front view of one example of the image fixing device.
Figure 2B:
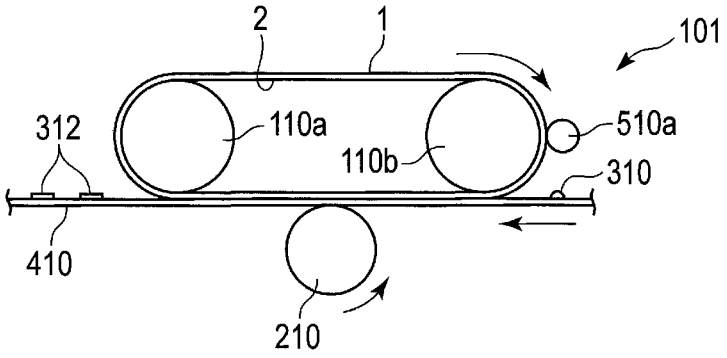
FIG. 2B is a side view showing the image fixing device of FIG. 2A viewed from side B.

FIGS. 2A and 2B show the heat fixing belt 1 that is set in one example of an image fixing device of an image forming apparatus such as a copier and a printer. FIG. 2A is a front view of one example of the image fixing device and FIG. 2B is a side view showing the image fixing device of FIG. 2A viewed from side B. In the image fixing device 101 shown in FIG. 2A, the heat fixing belt 1 is set in two core members 110*a* and 110*b* so as to be in contact with the inner surface 2 of the heat fixing belt 1. The two core members 110*a* and 110*b* are disposed at such a distance that the heat fixing belt 1 is disposed without slack. The image fixing device 101 includes a pressure roll 210 disposed between the core members 110*a* and 110*b* so as to be in contact with part of the outer circumferential surface of the heat fixing belt 1.

Part of the circumferential surface of a power feed roll 510*a* is brought into contact with part of the circumferential surfaces of the electrode layers 40*a* and 40*b* to supply current to the electrode layers 40*a* and 40*b*.

The pressure roll 210 is fixed such that its axis is parallel to the axis of the heat fixing belt 1 and the axes of the core members 110*a* and 110*b*. An object whose image is to be formed is transferred between the heat fixing belt 1 and the pressure roll 210. The object whose image is to be formed may be a support 410 on which toner 310 are placed. FIG. 2A shows an example where the object is transferred from the right side to the left side, this transfer is made by rotating the heat fixing belt 1 clockwise and rotating the pressure roll 210 counterclockwise while being pressed on the heat fixing belt 1. The toner 310 placed on the support 410 is heated and fixed between the heat fixing belt 1 and the pressure roll 210 to form a toner image 312.

Figure 3A:
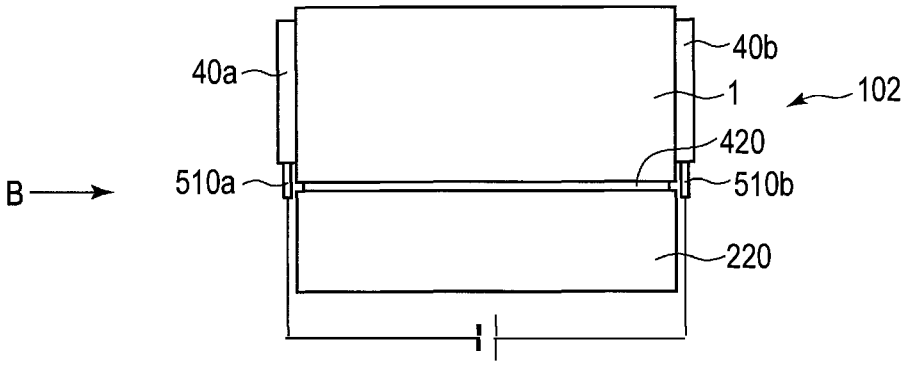
FIG. 3A is a front view showing one example of the image fixing device.
Figure 3B:
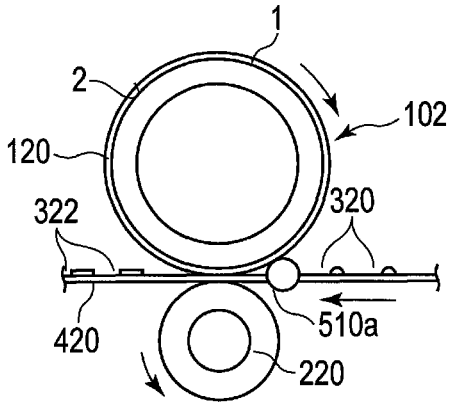
FIG. 3B is a side view of the image fixing device of FIG. 3A viewed from side B.

Though FIG. 2A shows an example where the heat fixing belt 1 is set in the image fixing device using two core members, the number of core members may be one. FIGS. 3A and 3B show its example. In FIGS. 3A and 3B, FIG. 3A is a front view showing one example of the image fixing device, FIG. 3B is a side view of the image fixing device of FIG. 3A viewed from side B. The heat fixing belt 1 is set in a core member 120 with an outside diameter which is inscribed in the inner surface 2 of the heat fixing belt 1. The image fixing device 102 includes a pressure roll 220 disposed and opposed to the heat fixing belt 1. Part of the circumferential surface of power feed sections 510*a* and 510*b* is brought into contact with part of the circumferential surfaces of the electrode layers 40*a* and 40*b* to supply current to the electrode layers 40*a* and 40*b*. The pressure roll 220 is fixed such that its axis is parallel to the axis of the heat fixing belt 1. An object 420 on which toner 320 is placed is transferred between the heat fixing belt 1 and the pressure roll 220. Like in FIGS. 2A and 2B, the transfer is from the right side to the left side, and the pressure roll 220 rotates while applying pressure to the heat fixing belt 1. The toner 320 is heated between the heat fixing belt 1 and the pressure roll 220 to fix a toner image 322.

In the image fixing devices 101 and 102, the core members 110*a*, 110*b* and 120 in which the heat fixing belt 1 is set may be coupled to a drive motor via a journal fixed to them respectively (not shown). The pressure rolls 210*a*, 210*b*, and 220 may also be coupled to the drive motor via the journal (not shown). The journal has only to be a shaft extending from each of the rolls in its central axis direction. The rolls can be rotated by rotating the shaft.

The power feed sections can be power feed rolls or power feed bearings. These are disposed such that their central axes are parallel to those of the electrode layers, and a power feed roll having a contact width corresponding to that of an electrode layer is disposed in contact with the surface of the electrode layer. When used, the heat fixing belt 1 and the power feed rolls are synchronized and rotate in direction opposite to each other to maintain contact with each other. With this contact, power is fed to the electrode layers from the fee rolls.

The contact width of the power feed roll may be equal to, smaller than or larger than that of the electrode layer.

According to one embodiment, there is provided an image fixing device to heat unfixed toner on a support to form a toner image. The image fixing device includes a heat fixing belt according to the foregoing embodiment, pressure rolls whose central axis is parallel to each other and which are disposed opposite to the heat fixing belt to sandwich the support between circumferential surfaces thereof, and a pair of power feed sections configured to feed power to each of paired electrode layers of the heat fixing belt.

The above image fixing device can be used in an image forming apparatus such as a copier and a printer. The method of incorporating the image fixing device in the image forming apparatus can be performed by a well-known method.

As described above, according to the embodiment, there is provided a heat fixing belt that excels in bending resistance and durability and an image fixing device including it. The heat fixing belt according to the embodiment, the volume resistance value can be lowered by increasing the amount of conductive materials and in this case, too, it can be obtained improved in bending resistance and durability.

Example

A heat fixing belt was manufactured and evaluated as follows.

1. Measurement Method (1) Measurement of Volume Resistance Value

The volume resistance value of each of an elastic resistive heat generation layer and an electrode layer, which are formed as described above, was measured by a method that conforms to JIS K-7194 using LORESTA-GP MCP-T610 (made by Mitsubishi Chemical Analytech Co., Ltd.). The measurement was conducted by leaving a measurement sample as it is for 24 hours or longer under the environment of temperature of 22±3° C. and RH of 55±5%.

In the elastic resistive heat generation layer, the total of forty portions in five portions in the belt width direction and eight portions in the belt circumferential direction were measured, and the uniformity of the volume resistance values was evaluated by a difference between the maximum and minimum values thereof.

(2) Measurement of Heating Generation Temperature Distribution

Figure 4:
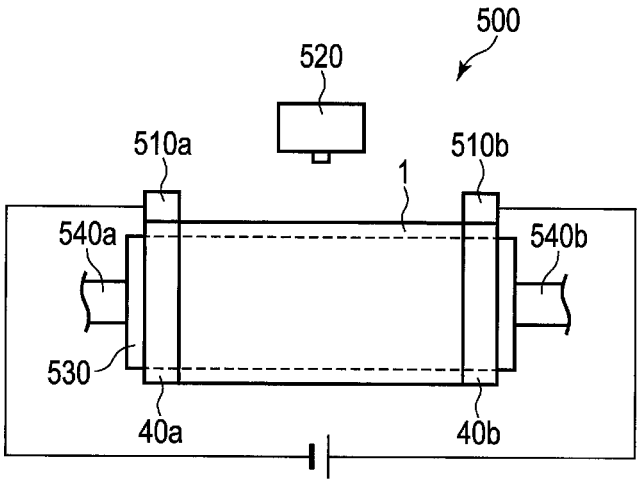
FIG. 4 is a diagram showing an outline of a measurement system for heat generation temperature distribution.

A schematic view of a measurement system is shown in FIG. 4. A silicone sponge roll 530 with an outside diameter of 25 mm was inserted in each of the heat fixing belts obtained as will be described later. The power feed sections 510*a* and 510*b* using metal bearings were brought into contact with the electrode layers 40*a* and 40*b* located at both ends of the heat fixing belt 1. After that, a voltage was applied between the electrode layers through the power feed sections 510*a* and 510*b*. The silicone sponge roll 530 is coupled to the drive motor via journals 540*a* and 540*b* to allow the heat fixing belt to rotate.

After power was started to apply between the electrode layers at both the ends, the applied voltage was adjusted until the surface temperature of the heat fixing belt 1 reaches the maximum value of 190° C. while confirming the surface temperature of the belt using a thermograph 520 (MobIR M4 made by IR System Co., Ltd.), the applied voltage was a set voltage. After that, the power supply was stopped temporarily and the heat fixing belt was cooled to room temperature. After the cooling, the set voltage was applied to the heat fixing belt to supply power while rotating the silicone sponge roll at 10 rpm. When 10 seconds have elapsed from the application, measurement of the surface temperature of the belt using the thermograph was started. The surface temperature was measured at eight portions in the belt circumferential direction and a difference between the maximum and minimum values of the surface temperatures was calculated to make a temperature distribution. However, 10 mm of each of the electrode portions located at both end portions of the belt was excluded from the calculation to make the temperature distribution.

(3) Measurement of Bending Resistance

Figure 5:
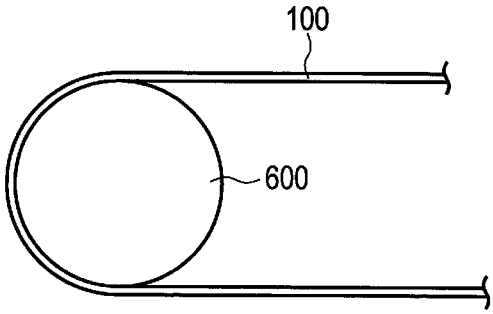
FIG. 5 is a diagram showing an outline of a measurement system for bending resistance.

The bending resistance of the elastic resistive heat generation layer formed as described above and the electrode layers formed on the surface of the elastic resistive heat generation layer was measured by a method that conforms to JIS K 5600-5-1 (cylindrical mandrel method). The outline of the measurement is shown in FIG. 5. A mandrel 600 with an outside diameter of 5 mm was used and a sample 100 was folded along the mandrel 600, after that, it was visually checked whether there were a crack and peeling on the surface. The measurement was conducted in the room-temperature environment (23±5° C.).

(4) Measurement of Adhesion

The adhesion between the elastic resistive heat generation layer and the electrode layers formed by the foregoing method was measured by a coated-film adhesion evaluation method which conforms to JIS K 5600-5-6 (cross-cut method). The result of the test was evaluated on a scale of classifications 0 to 5 according to the degree of peeling.

(5) Evaluation of Incorporating in Image Fixing Device

The heat fixing belt obtained by the foregoing method was incorporated in the image fixing device shown in FIG. 3A as described above to conduct a toner image fixing test. The fixing temperature was set at 190° C. with a thermistor to make printing.

2. Manufacture of Heat Fixing Belt

Inventive Example 1

(1) Formation of Base Material Layer

Polyamide acid (U-Varnish-S made by UBE Industries Ltd.) was applied to a stainless tube with an outside diameter of 30 mm and the entire length of 350 mm to a film thickness of 400 μm. After that, it was dried at 120° C. for 60 minutes, the temperature was increased up to 200° C. in 30 minutes, and it was held at 200° C. for 30 minutes. Then, the temperature was increased up to 380° C. in 30 minutes, and it was held at 380° C. for 15 minutes, thus completing the imidization reaction. After that, it was cooled to room temperature, the stainless tube was removed and its end portion was cut to obtain a polyimide-resin seamless tubular body with an inside diameter of 30 mm, a thickness of 70 μm and a length of 240 mm.

A stainless tube with an outside diameter of 30 mm and a length of 240 mm was inserted into the polyimide-resin seamless tubular body obtained as described above.

(2) Preparation for Elastic Resistive Heat Generation Layer Material

Fluorocarbon rubber coating used as an elastic resistive heat generation layer material was prepared by the following method. Using an open roll, 100% by weight of fluorocarbon rubber (G-501NK made by Daikin Industries, Ltd.) was kneaded with 20% by weight of MT carbon black (Thermax N990 made by Cancarb Limited: Thermax is a trademark registered in U.S., by Cancarb Limited), 15% by weight of magnesium oxide (KYOWAMAG 30 made by Kyowa Chemical Industry Co., Ltd.: KYOWAMAG is a trademark registered by Kyowa Chemical Industry Co., Ltd.) and 3% by weight of amine curing agent (V-3 made by Daikin Industries, Ltd.). After that, they were dissolved in MEK while adjusting the amount of MEK to have a solid content of 30%, thus obtaining fluorocarbon rubber coating. Dispersion of KETJENBLACK (MHI black series made by Mikuni-Color Limited) was mixed into the fluorocarbon rubber coating. The mixture amount was adjusted so as to have 20% by weight of KETJENBLACK to 100% by weight of fluorocarbon rubber in the solid content.

(3) Formation of Elastic Resistive Heat Generation Layer Material

An elastic resistive heat generation layer material was applied to the outer periphery of a polyimide-resin base material into which the stainless tube was inserted to a desired thickness by spray coating. It was dried at 40° C. for 10 minutes while rotating it, thus obtaining a laminated body A in which elastic resistive heat generation layers, which had not been cured, were laminated.

(4) Preparation for Electrode Layer Material

As the electrode layer material, the foregoing fluorocarbon rubber coating is mixed with a polyimide solution dissolved in NMP (RIKACOAT SN-20 made by New Japan Chemical CO., Ltd.: RIKACOAT is a trademark registered by New Japan Chemical CO., Ltd.), and silver particles were added thereto. The mixture amount was adjusted such that the silver particles were 150% by weight when the total of fluorocarbon rubber and polyimide resin in the solid content was 100% by weight. It was also adjusted such that when the total of fluorocarbon rubber and polyimide resin was 100% by weight, the fluorocarbon rubber was 30% by weight and the polyimide resin was 70% by weight.

(5) Formation of Electrode Layer

An electrode layer material was applied to 10 mm position of each of the end portions of the laminated body A to a desired thickness by blade coating. It was dried at 40° C. for 10 minutes while rotating it to obtain a laminated body B including a formed electrode layer, which had not been cured, at either end portion of the resistive heat generation layer that had not been cured. The laminated body B was heated and cured at 150° C. for one hour, at 180° C. for one hour and at 200° C. for 24 hours in the thermostatic chamber to obtain a laminated body C in which the elastic resistive heat generation layer and the electrode layers were formed on the base material. Measuring the film thickness after the curing, the elastic resistive heat generation layer was 150 μm and the electrode layer was 10 μm.

(6) Measurement of Volume Resistance Value

The volume resistance value of the elastic resistive heat generation layer was $2.56\times10^{1}$ Ω·cm, and of the forty points measured volume resistance values, the maximum value was 1.12 times as large as the minimum value. The volume resistance value of the electrode layer was $8.12\times10^{-4}$ Ω·cm.

(7) Measurement of Bending Resistance

Measurement of bending resistance was carried out. As a result, even though both the elastic resistive heat generation layer and the electrode layer were folded along the mandrel with an outside diameter of 5 mm, a defect such as a crack and peeling did not occur on the surface of the layers.

(8) Measurement of Adhesion

Evaluating the adhesion between the electrode layer and the elastic resistive heat generation layer, classification was 0 and no peeling was detected.

(9) Formation of Elastic Layer

The surface of a central area of the above laminated body C excluding 10 mm of both ends was coated with silicone rubber (XE15-B7354 made by Momentive Performance Materials Inc.) using primer (Primer No. 4 made by Shin-Etsu Chemical Co., Ltd.). The coating was performed by immersing the laminated body C with 10 mm of both end masked in a silicone rubber raw material and running an aluminum ring with an inside diameter of 30.65 mm on the outer circumferential surface.

After the coating, it was heated at 140° C. for 20 minutes and at 200° C. for four hours to vulcanize the silicone rubber. The thickness of the silicone rubber after the vulcanization was measured, it was 200 μm. Thereby, a laminated body D in which silicone rubber with a thickness of 200 μm was laminated on the laminated body C was obtained.

(10) Formation of Toner Release Layer

The surface of the silicone rubber layer of the above laminated body D was coated with fluorocarbon resin dispersion (855-510 made by Du Pont-Mitsui Fluorochemicals Co., Ltd.) by spray coating using primer (PJ-CL990 made by Du Pont-Mitsui Fluorochemicals Co., Ltd.). After the coating, it was dried at room temperature for 30 minutes and then put in an oven at 340° C. to burn for 15 minutes. The thickness of the burned toner release layer was measured and it was 15 μm.

The heat fixing belt according to the embodiment was obtained by (1) to (10) described above. This was an inventive example 1.

Inventive Example 2

A heat fixing belt was manufactured as in inventive example 1 except that the mixture amount of dispersion of KETJENBLACK was adjusted such that the volume resistance value of an elastic resistive heat generation layer was $1\times10^{3}$ Ω·cm in the elastic resistive heat generation layer material. The mixture amount of KETJENBLACK based on 100% by weight of fluorocarbon rubber in the solid content was 10% by weight and the thickness of the elastic resistive heat generation layer was 220 μm.

Inventive Example 3

A heat fixing belt was manufactured as in inventive example 1 except that the mixture amount of dispersion of a carbon nanotube (CNTD series developed by Mikuni-Color Limited) was adjusted such that the volume resistance value of an elastic resistive heat generation layer was $1\times10^{-3}$ Ω·cm in the elastic resistive heat generation layer material. The mixture amount of the carbon nanotube based on 100% by weight of fluorocarbon rubber in the solid content was 50% by weight and the thickness of the resistive heat generation layer was 38 μm.

Inventive Example 4

A heat fixing belt was manufactured as in example 1 except that the binder components of the electrode layer material was adjusted such that in the total of fluorocarbon rubber and polyimide resin was 100% by weight, the fluorocarbon rubber was 10% by weight and the polyimide resin was 90% by weight.

Inventive Example 5

A heat fixing belt was manufactured as in example 1 except that the binder components were fluorocarbon rubber only in the electrode layer material.

Comparative Example

In the elastic resistive heat generation layer material, a conductive polyimide solution in which the mixture amount of dispersion of KETJENBLACK (MHI black series made by Mikuni-Color Limited) in a polyimide solution (RIKA-COAT SN-20 made by New Japan Chemical CO., Ltd.) was adjusted such that the volume resistance value of an elastic resistive heat generation layer was $2.5\times10^{1}$ Ω·cm was used. The mixture amount of KETJENBLACK based on 100% by weight of polyimide resin in the solid content was 22% by weight. A heat fixing belt was manufactured as in example 1 except that these elastic resistive heat generation layer materials and the electrode layer material were used. The thickness of the resistive heat generation layer was 15 μm.

[Result]

(1) Evaluation of Elastic Resistive Heat Generation Layer

The elastic resistive heat generation layer of each of the inventive example 1, inventive example 2, inventive example 3 and comparative example was evaluated regarding the following evaluations. The measurement items were volume resistance value, variations in volume resistance value, bending resistance of elastic resistive heat generation layer and heating temperature distribution. The results are shown in Table 1.

TABLE 1

| | | Inventive example 1 | Inventive example 2 | Inventive example 3 | Comparative example |
|---|---|---|---|---|---|
| Elastic resistive heat generation layer material | Binder | Fluorocarbon rubber | Fluorocarbon rubber | Fluorocarbon rubber | Polyimide resin |
| Elastic resistive heat generation layer | | | | | |
| Volume resistance value | Ω · cm | $2.56 \times 10^{1}$ | $1.00 \times 10^{3}$ | $1.00 \times 10^{-3}$ | $2.50 \times 10^{1}$ |
| Variations in volume resistance value | Maximum value/ minimum value | 1.12 times | 1.27 times | 1.10 times | 1.10 times |
| Bending resistance of elastic resistive heat generation layer | Visual | Superior | Superior | Superior | Inferior |
| Heating temperature distribution | | | | | |
| Temperature distribution | Maximum value − minimum value | Δ8.5° C. | Δ12.5° C. | Δ9.8° C. | Δ10.8° C. |

The volume resistance value in each of the examples fell within the range of $1.00\times10^{-3}$ or higher and $1.00\times10^{3}$ or lower. The variations in volume resistance value were shown as a multiple obtained by dividing the maximum value of the volume resistance value by the minimum value thereof. All of these were included within a range of 1.10 times to 1.3 times. As a result of visually evaluating the bending resistance of the elastic resistive heat generation layer, in each of the inventive example 1, inventive example 2, and inventive example 3, it was satisfactory. In the comparative example, however, the bending resistance was inferior. The temperature distribution was indicated by a value A obtained by subtracting the minimum value from the maximum value. All of these were included within a range of 8.5° C. to 13° C.

(2) Evaluation of Electrode Layer

Regarding inventive example 1, inventive example 4, and inventive example 5, the volume resistance value of the electrode layer, the bending resistance of the electrode layer, the adhesion between the elastic resistive heat generation layer and the electrode layer, and the heating temperature distribution were evaluated. The results are shown in Table 2.

TABLE 2

| | | Inventive example 1 | Inventive example 4 | Inventive example 5 |
|---|---|---|---|---|
| Percentages of fluorocarbon rubber in binder of electrode layers | % by weight | 30% by weight | 10% by weight | 100% by weight |
| Volume resistance values of electrode layers | Ω · cm | $8.12 \times 10^{-4}$ | $6.05 \times 10^{-4}$ | $9.70 \times 10^{-4}$ |
| Bending resistance of electrode layers | Visual | Superior | Superior | Superior |

TABLE 2-continued

| | | Inventive example 1 | Inventive example 4 | Inventive example 5 |
|---|---|---|---|---|
| Adhesion between elastic resistive heat generation layer and electrode layer | Classification 0 to 5 | Classification 0 No peeling in electrode | Classification 1 Small peeling of 5% or less in electrode | Classification 0 No peeling in electrode |
| Heating temperature distribution | | | | |
| Temperature distribution | Maximum value − minimum value | Δ8.5° C. | Δ9.7° C. | Δ8.9° C. |

The percentages of fluorocarbon rubber in the binder of the electrode layers in the inventive example 1, inventive example 4, and inventive example 5 were 30% by weight, 10% by weight and 100% by weight, respectively. The volume resistance values of these electrode layers were $8.12\times10^{-4}$ Ω·cm, $6.05\times10^{-4}$ Ω·cm and $9.70\times10^{-4}$ Ω·cm, and these values were lower than the volume resistance value of the elastic resistive heat generation layer in each of the example and equal to or lower than $1.0\times10^{-3}$ Ω·cm. In the relation with the foregoing volume resistance value of the elastic resistive heat generation layer, the heat fixing belt according to the embodiment having such a characteristic can supply sufficient current comprehensively to the elastic resistive heat generation layer from the electrode layer.

Regarding the adhesion between the elastic resistive heat generation layer and the electrode layer, inventive example 4 was classification 1 and small peeling of 5% or less was observed, which fell within an acceptable range. Inventive example 1 and inventive example 5 are classification 0 and no peeling was observed in the electrode. The temperature distributions in the inventive example 1, inventive example 4, and inventive example 5 were Δ8.5° C., Δ9.7° C. and Δ8.9° C. and it has been showed that they are sufficiently uniform temperature distributions.

(3) Mounting Test

The heat fixing belt obtained in inventive example 1 was incorporated into the image fixing device shown in FIG. 3A to conduct a toner image fixing test. The fixing temperature was set at 190° C. by a thermistor to make printing. Consequently, toner was fixed instantaneously when power was turned on to obtain a satisfactory fixing image.

3. Summary

It has been proved that the inventive example 1, inventive example 2, inventive example 3, inventive example 4, and inventive example 5 in which fluorocarbon rubber is contained in binder components and binders of the same type are used in the elastic resistive heat generation layer and the electrode layer are excellent in bending resistance. The temperature distribution of each of these was uniform. In contrast, the comparative example in which polyimide resin is used for the binder is inferior in bending resistance though a uniform temperature distribution is obtained.

It is evident from the above results that a heat fixing belt according to the embodiment which excels in bending resistance and durability is provided. The heat fixing belt can be decreased in volume resistance value by increasing the amount of conductive materials and, in this case, too, it has been proved that it achieved the excellent bending resistance and durability. It has also been proved that a satisfactory toner image is obtained by an image fixing device with the heat fixing belt.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, manufacturing technology, and testing capability.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A heat fixing belt comprising a tubular belt base formed of an insulative heat-resistant resin, an elastic resistive heat generation layer containing a conductive material and formed of an elastic base material including an elastic material, a toner release layer, and a pair of electrode layers to feed power to the elastic resistive heat generation layer, wherein:

the elastic resistive heat generation layer is provided on an outer circumferential surface of the belt base;

the toner release layer is provided as an outermost layer; and the pair of electrode layers are provided at both side end portions of an outer circumferential surface of the elastic resistive heat generation layer and have a volume resistance value that is lower than a volume resistance value of the elastic resistive heat generation layer.

2. The heat fixing belt of claim 1, wherein the elastic resistive heat generation layer has a volume resistivity of 1.0×10−3 Ω·cm or higher and 1.0×103 Ω·cm or lower.

3. The heat fixing belt of claim 1, further comprising an elastic layer between the elastic resistive heat generation layer and the toner release layer, the elastic layer being in contact with the elastic resistive heat generation layer and the toner release layer.

4. The heat fixing belt of claim 1, wherein the elastic material is fluorocarbon rubber, silicone rubber, fluorosilicone rubber, hydrogenated nitrile rubber, or a combination thereof.

5. The heat fixing belt of claim 4, wherein the elastic material is fluorocarbon rubber alone, a mixture of fluorocarbon rubber and one of silicone rubber, fluorosilicone rubber and hydrogenated nitrile rubber, fluorosilicone rubber alone, or a mixture of fluorosilicone rubber and one of silicone rubber and hydrogenated nitrile rubber.

6. The heat fixing belt of claim 1, wherein the pair of electrode layers each have a volume resistance value of 1.0×10−3 Ω·cm or lower.

7. The heat fixing belt of claim 1, wherein:

the pair of electrode layers are formed of binder containing metallic particles, respectively;

the binder includes an elastic base material of a same type as that of an elastic base material of the elastic resistive heat generation layer; and the pair of electrode layers and the elastic resistive heat generation layer are coupled directly without using an adhesive.

8. The heat fixing belt of claim 1, wherein the elastic base material further includes a heat-resistant material other than the elastic material.

9. The heat fixing belt of claim 8, wherein the heat-resistant material is polyphenylene sulfide, polyimide, polyamide-imide, polyether ether ketone or fluorine resin.

10. A method for manufacturing a heat fixing belt, comprising the steps of:

preparing coating material for an elastic base material containing curing agent and a heat-resistant elastic material;

preparing dispersion of a conductive material;

mixing the coating and the dispersion to obtain an elastic resistive heat generation layer material;

applying the elastic resistive heat generation layer material to an outer circumferential surface of a tubular belt base formed of an insulative heat-resistant resin and drying to form an elastic resistive heat generation layer that has not been cured;

applying an electrode material to both side end portions of an outer circumferential surface of the elastic resistive heat generation layer that has not been cured, drying, and thermally curing to form, on the belt base, an elastic resistive heat generation layer containing the conductive material and the elastic material and a pair of electrode layers to feed power to the elastic resistive heat generation layer, which having a volume resistance value that is lower than a volume resistance value of the elastic resistive heat generation layer; and forming a toner release layer on an outermost layer.

11. An image fixing device to heat unfixed toner on a support to form a toner image, the device comprising:

the heat fixing belt of claim 1;

pressure rolls whose central axis is parallel to each other and which are disposed opposite to the heat fixing belt to sandwich the support between circumferential surfaces thereof; and a pair of power feed sections configured to feed power to each of the pair of electrode layers.

* * * * *